US005951184A

United States Patent [19]

Sanchez

[11] Patent Number: 5,951,184

[45] Date of Patent: Sep. 14, 1999

[54] CANDY ATTACHMENT FOR A WRITING INSTRUMENT

[76] Inventor: Omar A. Sanchez, 9310 Fountainebleau Blvd. #A-405, Miami, Fla. 33172

[21] Appl. No.: 08/827,960

[22] Filed: May 13, 1997

[51] Int. Cl.[6] ..... B43K 29/00

[52] U.S. Cl. ..... 401/52; 401/34

[58] Field of Search ..... 401/34, 52; 15/431

[56] References Cited

U.S. PATENT DOCUMENTS

| | | | |
|---|---|---|---|
| 165,531 | 7/1875 | Bennett | 15/431 |
| 701,072 | 5/1902 | Morris | 401/52 X |
| 2,610,077 | 9/1952 | Swanson | 401/34 X |
| 3,615,596 | 10/1971 | Petti et al. | 401/52 |
| 3,639,069 | 2/1972 | Gordon | 401/52 X |
| 5,318,372 | 6/1994 | Besthorne | 401/34 X |

*Primary Examiner*—Steven A. Bratlie

[57] ABSTRACT

A new candy attachment for a writing instrument for allowing a user to removably mount candy to an end of a writing instrument. The inventive device includes an edible candy member having a cylindrical lower end which is frictionally inserted into the cylindrical upper hollow interior of a connector sleeve. The lower section hollow interior is shaped to frictionally hold an end of a writing instrument therein.

1 Claim, 3 Drawing Sheets

CANDY ATTACHMENT FOR A WRITING INSTRUMENT

BACKGROUND OF THE INVENTION

1. Field of the Invention

The present invention relates to candy novelty items and more particularly pertains to a new candy attachment for a writing instrument for allowing a user to removably mount candy to an end of a writing instrument.

2. Description of the Prior Art

The use of candy novelty items is known in the prior art. More specifically, candy novelty items heretofore devised and utilized are known to consist basically of familiar, expected and obvious structural configurations, notwithstanding the myriad of designs encompassed by the crowded prior art which have been developed for the fulfillment of countless objectives and requirements.

Known prior art candy novelty items include U.S. Pat. No. 5,202,707; U.S. Pat. No. 5,207,174; U.S. Pat. No. 5,324,527; U.S. Pat. No. 5,222,627; U.S. Pat. No. 4,914,748; and U.S. Pat. No. Des. 249,333.

While these devices fulfill their respective, particular objectives and requirements, the aforementioned patents do not disclose a new candy attachment for a writing instrument. The inventive device includes an edible candy member having a cylindrical lower end which is frictionally inserted into the cylindrical upper hollow interior of a connector sleeve. The lower section hollow interior is shaped to frictionally hold an end of a writing instrument therein.

In these respects, the candy attachment for a writing instrument according to the present invention substantially departs from the conventional concepts and designs of the prior art, and in so doing provides an apparatus primarily developed for the purpose of allowing a user to removably mount candy to an end of a writing instrument.

SUMMARY OF THE INVENTION

In view of the foregoing disadvantages inherent in the known types of candy novelty items now present in the prior art, the present invention provides a new candy attachment for a writing instrument construction wherein the same can be utilized for allowing a user to removably mount candy to an end of a writing instrument.

The general purpose of the present invention, which will be described subsequently in greater detail, is to provide a new candy attachment for a writing instrument apparatus and method which has many of the advantages of the candy novelty items mentioned heretofore and many novel features that result in a new candy attachment for a writing instrument which is not anticipated, rendered obvious, suggested, or even implied by any of the prior art candy novelty items, either alone or in any combination thereof.

To attain this, the present invention generally comprises an edible candy member having a cylindrical lower end which is frictionally inserted into the cylindrical upper hollow interior of a connector sleeve. The lower section hollow interior is shaped to frictionally hold an end of a writing instrument therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new candy attachment for a writing instrument which may be easily and efficiently manufactured and marketed.

It is a further object of the present invention to provide a new candy attachment for a writing instrument which is of a durable and reliable construction.

An even further object of the present invention is to provide a new candy attachment for a writing instrument which is susceptible of a low cost of manufacture with regard to both materials and labor, and which accordingly is then susceptible of low prices of sale to the consuming public, thereby making such candy attachment for a writing instrument economically available to the buying public.

Still another object of the present invention is to provide a new candy attachment for a writing instrument for allowing a user to removably mount candy to an end of a writing instrument.

Yet another object of the present invention is to provide a new candy attachment for a writing instrument which includes an edible candy member having a cylindrical lower end which is frictionally inserted into the cylindrical upper hollow interior of a connector sleeve. The lower section hollow interior is shaped to frictionally hold an end of a writing instrument therein.

Still yet another object of the present invention is to provide a new candy attachment for a writing instrument that allows the attachment of variously shaped candy, including animals, cartoon characters, sports equipment, and team logos, to the end of a writing instrument.

Even still another object of the present invention is to provide a new candy attachment for a writing instrument that allows attachment of candy of various types and flavors including, for example, fruit, mint, and bubble gum.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
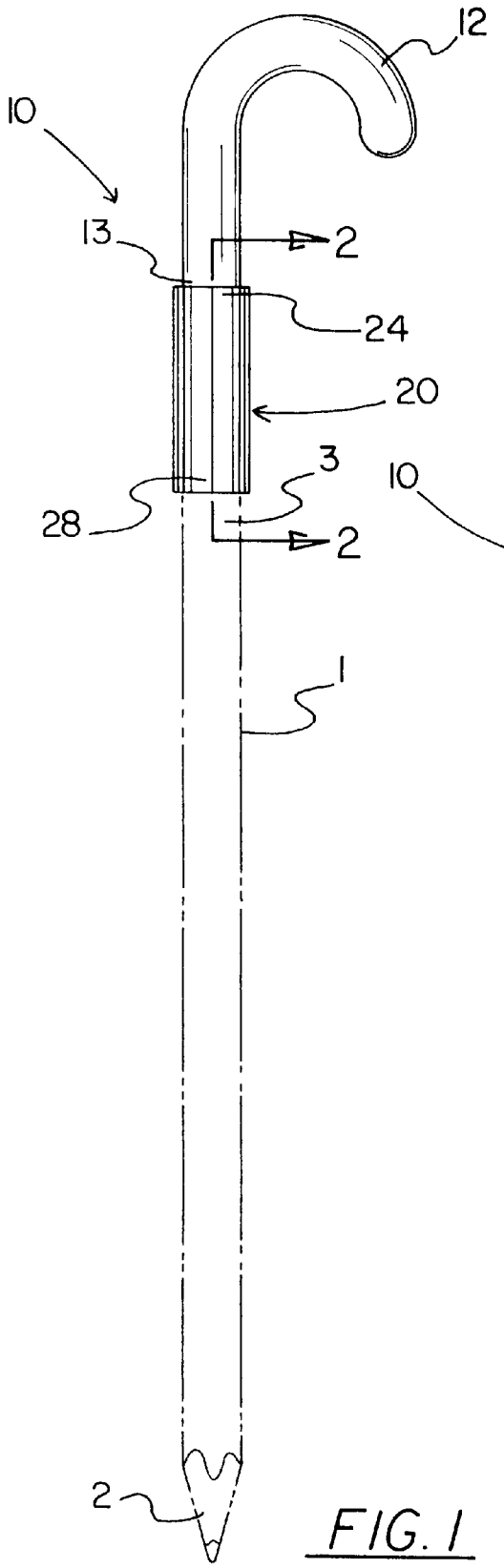
FIG. 1 is a side view of a new candy attachment for a writing instrument according to the present invention attached to an end of a pencil.

With reference now to the drawings, and in particular to FIGS. 1 through 6 thereof, a new candy attachment for a writing instrument embodying the principles and concepts of the present invention and generally designated by the reference numeral 10 will be described.

As best illustrated in FIGS. 1 through 6, the candy attachment for a writing instrument 10 is designed for attachment to a writing instrument 1 such as a pencil or pen having a writing element 2 at one end and a second end 3 that may commonly include an eraser.

The candy attachment 10 comprises a connector sleeve 20 having a hollow interior 21, an open upper end 24 for permitting insertion of candy the hollow interior 21, and an open lower end 28 for connecting to a writing instrument 1 by insertion of the second end 3 into the hollow interior 21.

A preferred embodiment of the candy attachment 10 is depicted in FIGS. 1, 2, 5, 6. In this preferred embodiment, the candy attachment 10 includes an edible candy member 12. The candy member has a cylindrical lower end 13. The candy member 12 can be any type of candy. Ideally, the candy member 12 should be hard such as a sucker-type candy. The candy member 12 can also be shaped into a variety of shapes including animals, cartoon characters, and sports team logos and equipment.

The connector sleeve 20 has an upper section 23 and a lower section 27. The upper section extends to the upper end 24 while the lower section 27 extends to the lower end 28.

A partition 22 is disposed within the hollow interior 21 between the upper and lower sections 23,27 to divide the hollow interior 21 into an upper hollow interior 25 and a lower hollow interior 29.

Ideally, the connector sleeve 20 is has a cylindrically-shaped outer surface.

Preferably, the interior surface of the upper section 23 has a circular cross section so that the upper hollow interior 25 is cylindrically shaped. Also preferably, the opening of the upper end 24 is circle-shaped to correspond with the upper hollow interior 25.

The candy member lower end 13 is inserted through the circle-shaped opening 24 into the upper hollow interior 25. Ideally, the candy member lower end 13 is frictionally held within the upper hollow interior 25 by the upper section interior surface 23 of the connector sleeve 20.

Figure 2:
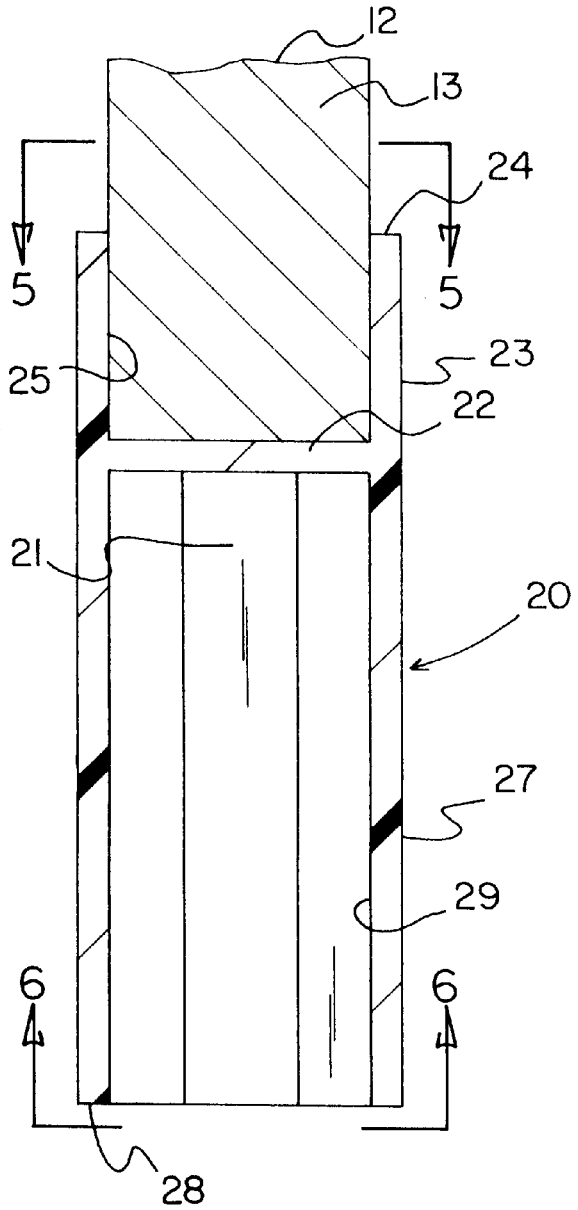
FIG. 2 is a cross sectional view of the present invention taken from line 2—2 of FIG. 1.
Figure 6:
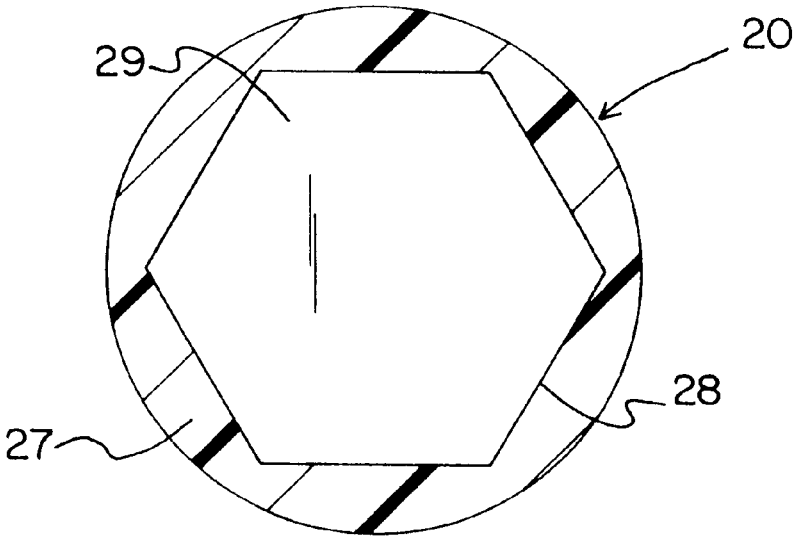
FIG. 6 is a bottom cross sectional view of the present invention taken from line 6—6 of FIG. 2.
Figure 5:
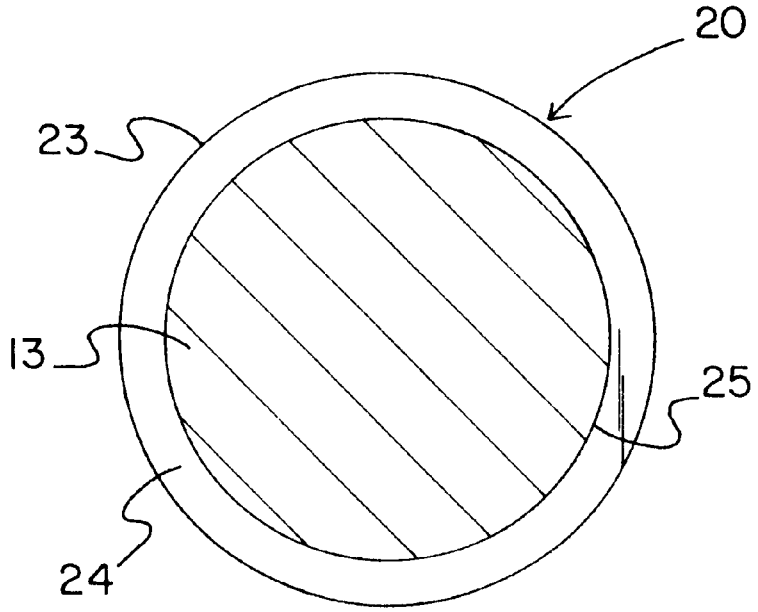
FIG. 5 is a top cross sectional view of the present invention taken from line 5—5 of FIG. 2.

With reference to FIGS. 2 and 6, the interior surface of the lower section 27 has a hexagonal cross section to define the sides of the lower hollow interior 29. Similarly, the opening of the lower end 28 into the lower hollow interior 29 is hexagon-shaped to correspond with the cross sectional shape of the lower hollow interior 29. The hexagon-shaped opening 28 permits insertion therethrough the second end 3 of a writing instrument 1 into the lower hollow interior 29. Most preferably, the lower section interior surface 27 is shaped to correspond with the exterior shape of the second end 3 of the writing instrument 1 so that the writing instrument 1 is frictionally held within the lower hollow interior 29.

Figure 3:
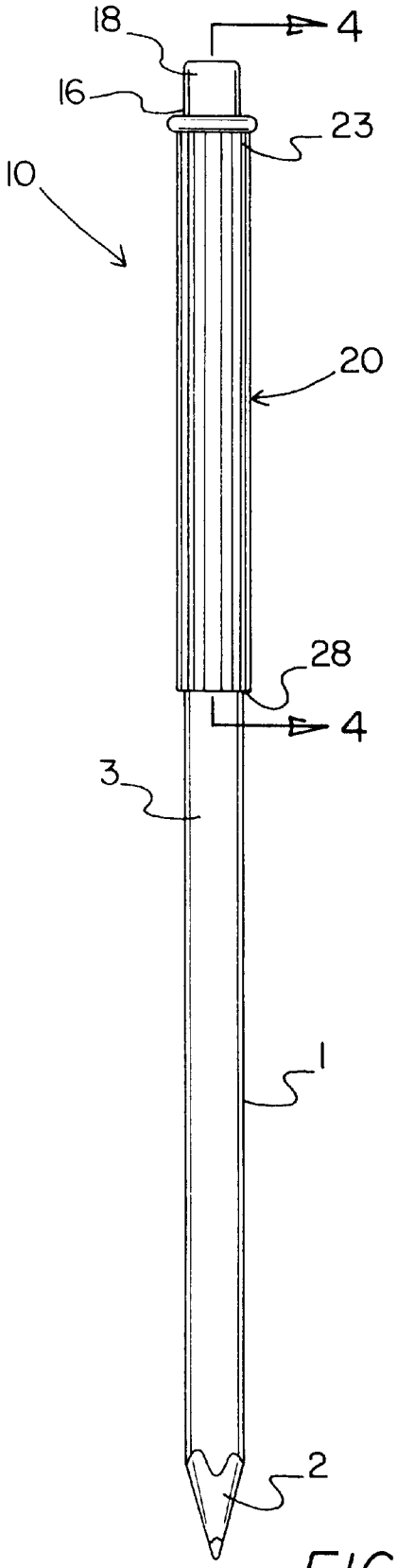
FIG. 3 is a side view an alternate embodiment of the present invention having an elongated connector sleeve.
Figure 4:
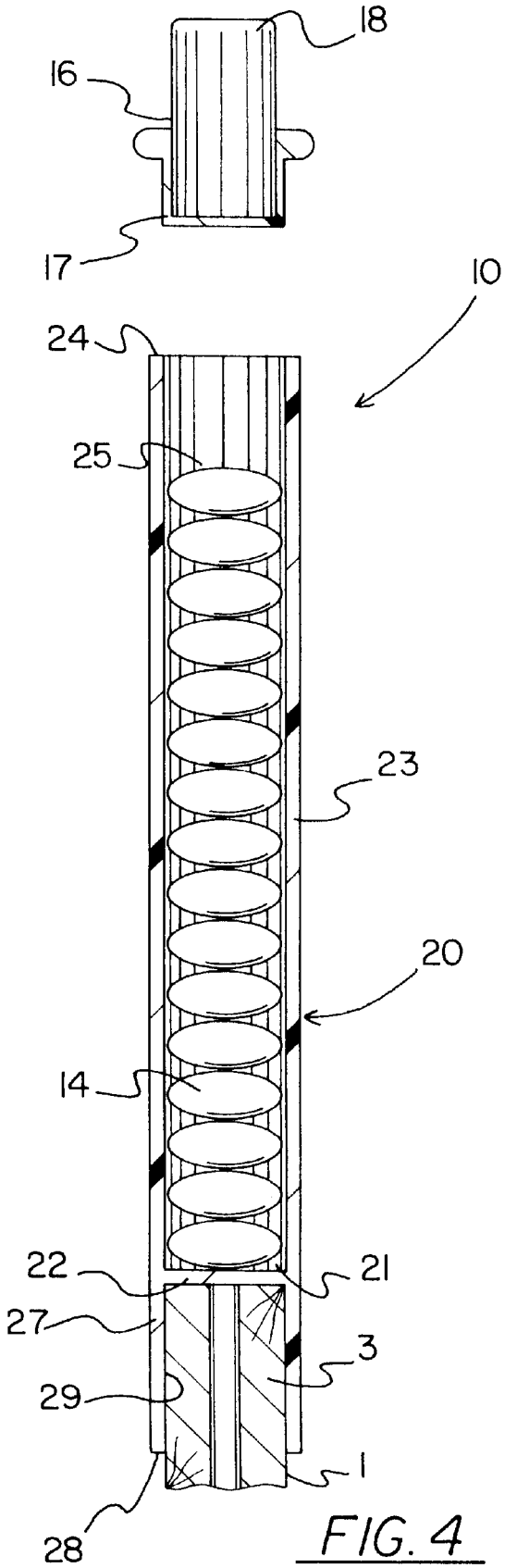
FIG. 4 is a cross section view of the alternate embodiment of the present invention taken from line 4—4 of FIG. 3 showing the candies within the upper hollow interior.

FIGS. 3 and 4 depict a second embodiment of the candy attachment 10. In this embodiment, the connector sleeve upper section 23 and its upper hollow interior is elongated to permit storing of small candies 14 within it.

This embodiment includes a lid member 16. Its lower end 17 is designed so that it is removably insertable through the connector sleeve member upper end 24 to close the connector sleeve upper section hollow interior 25 so that the candies 14 stored within upper hollow interior 25 do not accidentally fall out. Optionally, the lid member includes an eraser 18 on its upper end. The upper end may also be fashioned into any desired decorative shape.

In use, the connector sleeve 20 allows attachment of a candy source 12,14 to the end of a writing instrument 3 to facilitate the eating of the candy while holding the writing instrument 1. The connector sleeve 20 of the candy attachment 10 also allows the candy 12,14 to be removed from the writing instrument 1 without unnecessary direct contact and handling of the candy 12,14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination a candy dispenser; and a writing instrument having a writing element at one end and a second end, said candy dispenser comprising:

a plurality of discrete candy pieces;

a connector sleeve having an upper section, a lower section separated from the upper section by a partition, an upper end, and a lower end, said upper section extending between said partition and said upper end, said lower section extending between said partition and said lower end;

said lower section having an interior surface defining a lower hollow interior, said lower section interior surface having a hexagonal cross-section, said lower end having a hexagon-shaped opening into said lower hollow interior, said hexagon-shaped opening being for inserting therethrough a second end of a writing instrument into said lower hollow interior, said lower section interior surface being for frictionally holding the second end of the writing instrument in said lower hollow interior;

said upper section having an interior surface defining a cylindrical upper hollow interior, said upper end having a circular opening into said upper hollow interior, said candy pieces being inserted through said circular opening into said upper hollow interior, said candy pieces being positioned within the upper hollow interior in a longitudinal linear alignment such that said candy pieces are removable through said circular opening one at a time; and a lid member having a lower end with a generally planar circular configuration and a generally cylindrical peripheral wall coupled to the lower end and extending upwardly therefrom to define an interior space and an upper peripheral edge which has an peripheral lip extending radially outwardly therefrom with an outer edge having a semicircular cross-section, wherein an outer surface of the peripheral wall of the lid member has a diameter less than that of the interior surface of the upper section, said lid member lower end being fittedly inserted through said connector sleeve upper end to close said upper hollow interior;

wherein said lid member includes an eraser with a generally cylindrical configuration fitted in the interior space of the lid member and extending therefrom;

wherein the connector sleeve has a cylindrical outer surface with a uniform diameter along an entire length thereof, the upper section of the connector sleeve having a height which is about 6 times that of the lower section and the interior surface of the upper section has a width which is about equal to that of the lower section.

* * * * *